US007093842B2

(12) United States Patent
Chmelar

(10) Patent No.: US 7,093,842 B2
(45) Date of Patent: Aug. 22, 2006

(54) SKATEBOARD TRUCK ASSEMBLY

(76) Inventor: Erik Vaclav Chmelar, 371 Elan Village Ln., Apt 112, San Jose, CA (US) 95134

( * ) Notice: Subject to any disclaimer, the term of this patent is extended or adjusted under 35 U.S.C. 154(b) by 156 days.

(21) Appl. No.: 10/983,276

(22) Filed: Nov. 8, 2004

(65) Prior Publication Data

US 2006/0097470 A1 May 11, 2006

(51) Int. Cl.
*B62M 1/00* (2006.01)

(52) U.S. Cl. ..... 280/87.042; 280/87.041; 280/11.27; 280/11.28

(58) Field of Classification Search ..... 280/87.042, 280/87.041, 11.27, 11.28
See application file for complete search history.

(56) References Cited

U.S. PATENT DOCUMENTS

| | | | | |
|---|---|---|---|---|
| 3,649,038 | A * | 3/1972 | Huckenbeck | 280/11.28 |
| 4,061,350 | A * | 12/1977 | Schmidt et al. | 280/87.042 |
| 4,103,917 | A * | 8/1978 | Widolf | |
| 4,152,001 | A * | 5/1979 | Christianson | |
| 4,166,629 | A * | 9/1979 | List | |
| 4,176,850 | A * | 12/1979 | Johnson | |
| 4,184,693 | A | 1/1980 | Whitmarsh | |
| 4,185,847 | A | 1/1980 | Johnson | |
| 4,251,087 | A | 2/1981 | Hansen | |
| 4,398,734 | A | 8/1983 | Barnard | |
| 5,263,725 | A | 11/1993 | Gesmer et al. | |
| 5,971,411 | A | 10/1999 | Jones et al. | |
| 6,182,987 | B1 | 2/2001 | Bryant | |
| D439,945 | S | 4/2001 | Kent | |
| 6,224,076 | B1 | 5/2001 | Kent | |
| 6,315,304 | B1 | 11/2001 | Kirkland et al. | |
| 6,315,312 | B1 | 11/2001 | Reyes et al. | |
| 6,318,739 | B1 * | 11/2001 | Fehn, Jr. | 280/11.28 |
| 6,367,819 | B1 | 4/2002 | Andersen et al. | |
| 6,428,023 | B1 | 8/2002 | Reyes et al. | |
| 6,443,471 | B1 | 9/2002 | Mullen | |
| 6,474,666 | B1 | 11/2002 | Andersen et al. | |
| 6,523,837 | B1 | 2/2003 | Kirkland | |
| 6,547,262 | B1 | 4/2003 | Yamada et al. | |
| 6,793,224 | B1 * | 9/2004 | Stratton | 280/87.042 |
| 7,044,485 | B1 * | 5/2006 | Kent et al. | 280/87.042 |

* cited by examiner

*Primary Examiner*—J. Allen Shriver
*Assistant Examiner*—Cynthia F. Collado

(57) ABSTRACT

A skateboard truck assembly that eliminates wheel bite without sacrificing the turning responsiveness thereof. The truck assembly includes a plurality of set screws disposed in the ring-shaped member of the hanger adjacent to the kingpin. The longitudinal axis of the plurality of set screws is generally parallel to the axle and generally perpendicular to the longitudinal axis of the kingpin. The distances between the plurality of set screws and the kingpin, adjustable by the user, determines the amount of wheel bite prevention. When the hanger pivots through an angle and causes a set screw to contact the kingpin, further pivoting of the hanger stops. In a further feature the shaft of the kingpin includes a plurality of flat surfaces adjacent to the plurality of set screws.

6 Claims, 8 Drawing Sheets

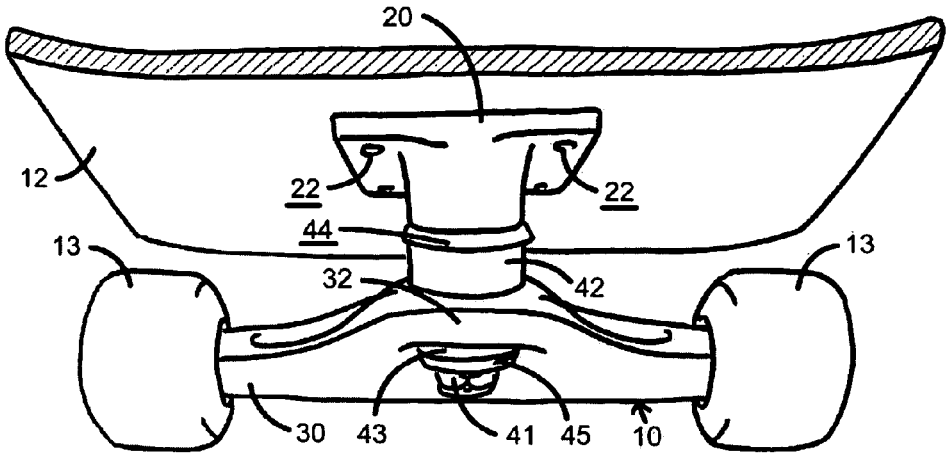
FIG. 5a (Prior Art)
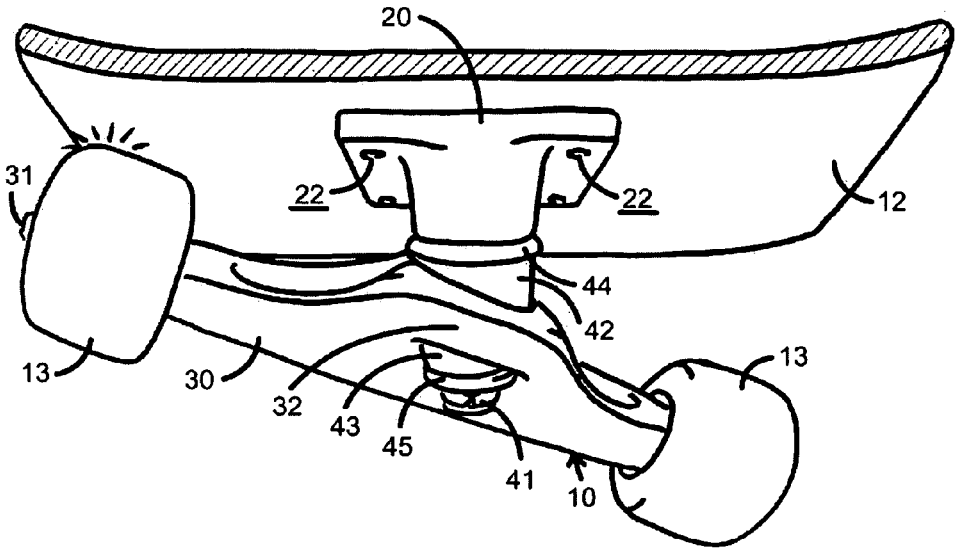
FIG. 5b (Prior Art)

SKATEBOARD TRUCK ASSEMBLY

BACKGROUND OF THE INVENTION

The present invention relates to vehicles that employ an axle or axle assembly that pivots relative to said vehicle to permit turning thereof. Specifically, the present invention prevents the axle of a vehicle to pivot beyond a specified angle, which can greatly increase the safety of said vehicle. This invention is therefore of great use for skateboards.

The axle assembly of a skateboard is called a "truck assembly" or simply a "truck." A skateboard typically comprises an elongated platform with a pair of trucks secured to the underside of said platform at opposite ends. Each truck typically comprises a "baseplate" and a "hanger." The baseplate is statically secured to the platform. The hanger is secured to the baseplate via a "kingpin" and compressible "bushings" that permit the hanger to pivot relative to the baseplate and platform. The hanger includes an axle to which wheels can be secured. Generally a complete skateboard comprises the platform, two trucks, and four wheels.

The primary direction of travel of a skateboard is along the longitudinal axis of the platform. When riding a skateboard, leaning in a direction generally perpendicular to the direction of travel causes the hangers to pivot relative to the platform and results in the skateboard turning in that direction.

The turning responsiveness of a particular truck is determined by the compressibility of the bushings and how tightly a ring-shaped member of the hanger is sandwiched between said bushings. The adjustability of said turning responsiveness is very important because different skateboarders prefer different turning responsiveness and even the same skateboarder may prefer different turning responsiveness at different times.

There are many skateboard trucks that permit the hanger to pivot via cushions, springs, cams, or struts instead of or in addition to bushings. However, because these trucks deviate greatly in appearance from typical skateboard trucks, they are undesired.

U.S. Pat. No. 6,793,224 (Stratton) discloses a skateboard truck that includes an arm carried by the base and a spring-loaded linkage connected between the base and the arm to bias the arm towards a center position aligned with the skateboard's direction of movement.

U.S. Pat. No. 6,523,837 (Kirkland) discloses an adjustable truck assembly for skateboards with a retainer that provides a large turning radius for the axle, a highly predictable turning performance, and tool-less adjustment of the turning performance.

U.S. Pat. No. 6,315,304 (Kirkland et. al.) discloses an adjustable truck assembly for a skateboard, which generally comprises an axle housing, a base, a kingpin connecting the axle housing and base, a turning mechanism between the axle housing and base around the kingpin consisting of opposed cam surfaces that are angled along the axis of the kingpin and an elastomeric bushing so that rotating the axle housing about the kingpin pushes the cam surfaces apart against the compression pressure of the elastomeric bushing, and an adjustment mechanism for adjusting the pressure against the bushing.

U.S. Pat. No. 6,224,076 (Kent) and U.S. Pat. No. D439,945 (Kent) disclose a pneumatic compression strut skateboard truck that utilizes a pneumatic compression strut suspension system, which is of the same type and kind used in automobiles and other mechanical devices employing shock absorbing technology.

U.S. Pat. No. 5,971,411 (Jones and Jones) discloses a skateboard truck, which generally comprises an extruded skateboard truck base that has an angled aperture for a cushion on which a hanger rests and a pivot bolt that holds the hanger to the base and that allows weight placed on either side of the skateboard to put pressure on the cushion to facilitate a turn.

U.S. Pat. No. 5,263,725 (Gesmer and Haug) discloses a skateboard truck that incorporates exceptionally rapid and consistently accurate axle rebound to the straight-ahead position, consistent and predictable steering response, an improved balance between stability and maneuverability, fine steering control, and a wide range of steering radii, which generally comprises a yoke, a pivot pin, and coil springs.

U.S. Pat. No. 4,251,087 (Hansen) discloses a truck apparatus for skate and skateboard devices, which generally comprises an elongated kingpin, a means for affixing the upper end of the kingpin to the bottom of a load carrying platform, a wheel axle carriage assembly pivotally affixed to the lower end of the kingpin and adapted to rotate about the axis of the kingpin, a resilient drag sleeve and turn restoring element compressively disposed between the first and second friction surfaces, and a lock nut for selectively urging the carriage assembly towards the mid-portioned member so as to compress the drag sleeve between the first and second friction surfaces such that the carriage assembly may be resistively and partially resiliently rotated about the axis of the kingpin.

U.S. Pat. No. 4,185,847 (Johnson) and U.S. Pat. No. 4,176,850 (Johnson) disclose skateboard trucks that carry a plurality of wheels mounted in independent suspension, which generally comprise longitudinally extending arms that carry the wheel axles forwardly or rearwardly relative to a mounting that secures the arms in rotatable fashion to the trucks and that are resiliently biased by means of separate springs or torsion bars.

U.S. Pat. No. 4,184,693 (Whitmarsh) discloses a skateboard truck, which generally comprises a base plate for securing to the underside of a skateboard platform and a spring member, such as a plate spring, that is joined to the base plate by one end and carries a wheel axle near an opposite end.

U.S. Pat. No. 4,152,001 (Christianson) discloses a truck for a skateboard or the like, which generally comprises an S-shaped leaf spring that attaches to the skateboard and, through a pivot pin, carries a transverse axle-supporting member at the opposite end and further generally comprises a pair of upwardly and inwardly inclined compression springs that are engaged by a pin carried by the leaf spring to resist pivotal movement of the leaf spring relative to the axle-supporting member.

An undesired characteristic of skateboard trucks is "wheel bite," which occurs when the hanger pivots relative to the platform until a wheel contacts the underside of the platform. When wheel bite occurs, the contacting wheel stops rotating and the skateboard rapidly stops moving, usually causing the skateboarder to fall. In skateboard trucks that employ only bushings, currently the only way to prevent wheel bite is to more tightly sandwich the ring-shaped member of the hanger between the bushings. However, this greatly decreases the turning responsiveness of the truck, and is therefore highly undesired.

U.S. Pat. No. 6,547,262 (Yamada and Hiranuma) discloses a skateboard truck assembly in which the pivot arm of the truck hanger rotates freely in a bearing assembly supporting the pivot arm in the socket hub.

U.S. Pat. No. 6,474,666 (Andersen and Andersen) discloses a shock-absorbing skate truck assembly that includes a resilient shock absorber at the kingpin located between the assembly base of the assembly and the axle support member for absorbing shocks encountered during use and another shock absorber that is located in a recess of the assembly base and is engaged by an axle support member arm.

U.S. Pat. No. 6,443,471 (Mullen) discloses a truck assembly configured to eliminate undesired ride characteristics such as hanger-jiggle and wheel bite without sacrificing the skateboard's steering responsiveness, which generally comprises an axle assembly with a ring-shaped hanger that is confined on a kingpin using a pair of bushings, at least one of which includes an annular flange that projects into an annular gap that is defined between the hanger and the kingpin.

U.S. Pat. No. 6,428,023 (Reyes and Horn) and U.S. Pat. No. 6,315,312 (Reyes and Horn) disclose a truck assembly including a housing adapted to be mounted to a skateboard or the like, which generally comprises an axle bracket that is mounted for rotation transverse to the longitudinal axis and that includes a projecting upper end portion and a bottom end portion adapted to receive a transversely extending axle and wheel assembly, a resilient member located at least partially in the housing that is adapted to resist transverse rotation of the axle bracket and provide a restoring force, and a wedge member that has an aperture configured for receiving the projecting upper end portion of the axle bracket to establish a direct coupling therebetween.

U.S. Pat. No. 6,367,819 (Andersen and Andersen) discloses a shock-absorbing skate truck assembly including a resilient shock absorber at the kingpin located between the assembly base of the assembly and the axle support member for absorbing shocks encountered during use.

U.S. Pat. No. 6,318,739 (Fehn, Jr.) discloses a suspension assembly for a skateboard which generally comprises a base plate with a truck plate pivotally attached at one end with a shock absorber located between the base plate and the truck plate and further with a projection on the base plate that protects the shock absorber and aids the rider in performing tricks.

U.S. Pat. No. 6,182,987 (Bryant) discloses a truck assembly with replaceable axles and ball joint pivots that incorporates precision steering and rocking components for consistency and accuracy during maneuvers, a method for removing or replacing worn or broken axles, and a precision ball pivot pin that acts as the associate pivotal and rocking mechanism for the truck assembly.

U.S. Pat. No. 4,398,734 (Barnard) discloses a truck design for a skate-type device involving turning and tilting axes of rotation, which generally comprises a T-shaped rod, the top part being housed in a base plate and the leg passing through a slot in the base plate, a resilient pad, washers, an axle yoke, and an adjustable lock nut.

U.S. Pat. No. 4,166,629 (List) discloses a skateboard truck, which generally comprises a base that has a first portion with a first hole therein and a second portion with a second hole therethrough, a hanger that has an axle for mounting wheels thereon, a ring and a pin, the pin being received in the first hole, and a coupling assembly for coupling the hanger to the base.

U.S. Pat. No. 4,103,917 (Widolf) discloses a skateboard truck, which generally includes a wheel housing resiliently mounted on a skateboard truck base by means of a fastener which extends through the housing and is threaded onto a stud fixed to the base to compress a tubular cushion between the housing and the base, in which the fastener has a square cross-section that mates with a square bore in the cushion so that rotation of the fastener with respect to the cushion is prevented except when the retainer is manually and forceably rotated to adjust the compression on the cushion.

Although U.S. Pat. No. 6,443,471 (Mullen) claims to solve wheel bite by teaching a bushing with an annular flange, the bushing is comprised of a soft material and is therefore not effective at preventing wheel bite. Furthermore, any achieved wheel bite prevention relies on how tightly the ring-shaped member of the hanger is sandwiched between the bushings, and therefore affects the turning responsiveness of the truck.

Accordingly, what is desired, and has not heretofore been developed, is a skateboard truck that prevents wheel bite without affecting the turning responsiveness thereof. It is further desired that the skateboard truck maintain the basic appearance of a typical skateboard truck. Finally, it is desired that the amount of wheel bite prevention be adjustable by the user.

BRIEF SUMMARY OF THE INVENTION

It is an object of the present invention to provide a skateboard truck that prevents wheel bite.

It is an object of the present invention to provide a skateboard truck wherein the amount of wheel bite prevention is easily adjustable by the user.

It is an object of the present invention to provide a skateboard truck wherein the amount of wheel bite prevention is independent of the turning responsiveness of the truck.

It is an object of the present invention to provide a skateboard truck that maintains the general appearance of a typical skateboard truck.

It is an object of the present invention to provide a skateboard truck that is inexpensive to manufacture.

It is an object of the present invention to provide a skateboard truck that is easy to use.

The above objects apply equally to any vehicle whose axle assembly pivots relative to said vehicle to permit turning thereof. The word "skateboard" is meant to describe any vehicle whose turning can be accomplished by a pivoting axle assembly.

The above objects, features, and advantages of the present invention will become apparent from the following detailed description when read in conjunction with the accompanying drawings, which illustrate by way of example, the principles of the invention. The same reference numerals are used to identify the same or similar parts in each of the accompanying drawings.

BRIEF DESCRIPTION OF THE DRAWINGS

FIG. 5*a* is a rear elevation view of a typical skateboard truck with wheels installed, said truck beneath a skateboard platform wherein the hanger is not pivoted and FIG. 5*b* is a rear elevation view of a typical skateboard truck with wheels installed, said truck beneath a skateboard platform wherein the hanger is pivoted causing wheel bite.

DETAILED DESCRIPTION OF THE INVENTION

Figure 1:
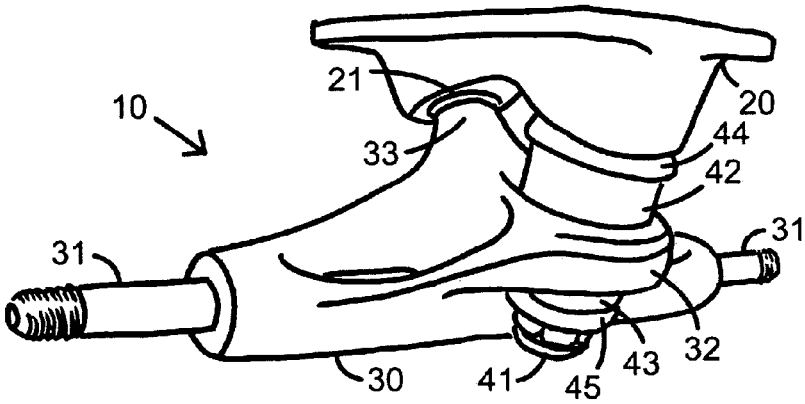
FIG. 1 (Prior Art)
FIG. 1 is a perspective view of a typical skateboard truck.
Figure 2:
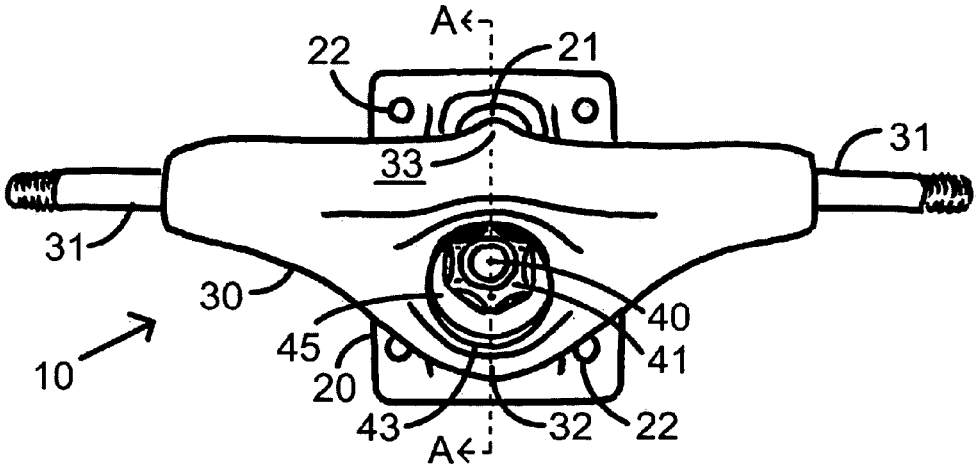
FIG. 2 (Prior Art)
FIG. 2 is a bottom elevation view of the skateboard truck shown in FIG. 1.
Figure 3:
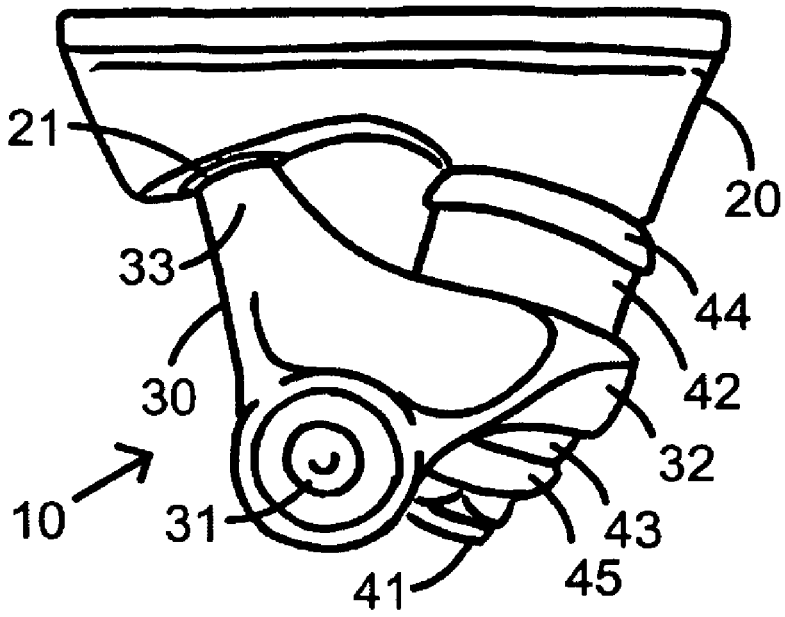
FIG. 3 (Prior Art)
FIG. 3 is a side elevation view of the skateboard truck shown in FIG. 1.
Figure 4:
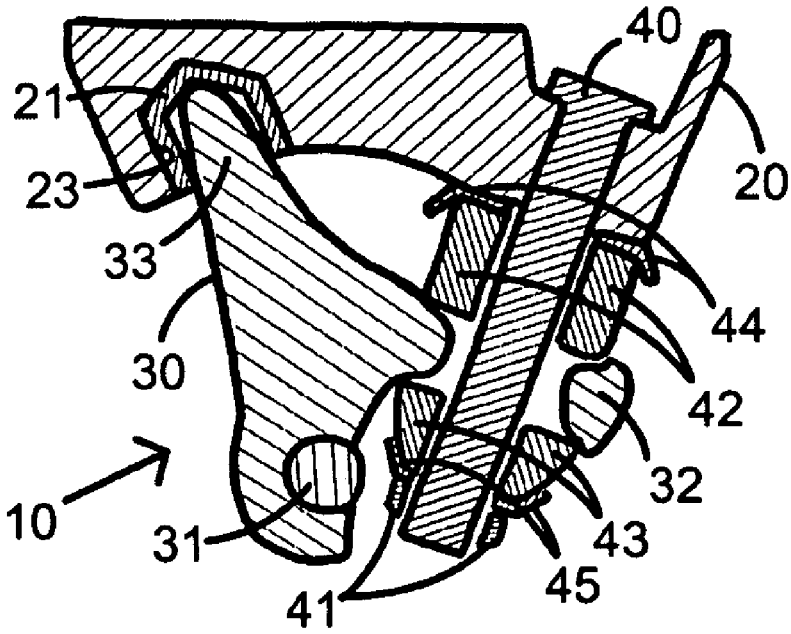
FIG. 4 (Prior Art)
FIG. 4 is a cross-sectional view of the skateboard truck shown in FIG. 2 taken along line A—A.

FIG. 1 shows a perspective view of a typical skateboard truck 10, which generally comprises a baseplate 20 and a hanger 30. FIG. 2 and FIG. 3 show bottom and side views of a typical truck 10, respectively. FIG. 4 shows a cross-sectional view of the truck 10 of FIG. 2 taken along line A—A. The baseplate 20 may be statically secured to the underside of a skateboard platform by inserting a bolt or screw through each of the mounting holes 22. The baseplate 20 includes a pivot recess 23 that accepts the pivot cup 21. The kingpin 40 protrudes downward from the baseplate 20.

The hanger 30 of the truck 10 includes an axle 31 on which wheels can be secured, a ring-shaped member 32, and a pivot stem 33. The ring-shaped member 32 is sandwiched between the upper bushing 42 and the lower bushing 43. An upper washer 44 is positioned above the upper bushing 42 and a lower washer 45 is positioned below the lower bushing 43. A kingpin nut 41 is attached to the end of the kingpin 40 to secure the hanger 30 to the baseplate 20. The kingpin nut 41 is tightened to achieve the desired turning responsiveness. The pivot stem 33 on which the hanger 30 pivots rests in the pivot cup 21.

FIG. 5*a* shows a typical skateboard truck 10 with wheels 13 installed, said truck 10 beneath a skateboard platform 12. Wheel bite occurs when the hanger 30, with wheels 13 secured to the axle 31, pivots so far that a wheel 13 contacts the underside of the platform 12 as shown in FIG. 5*b*. The only way to prevent wheel bite for the truck 10 shown in FIG. 1 through FIG. 5*b* is to very tightly sandwich the ring-shaped member 32 between the upper bushing 42 and lower bushing 43 by over-tightening the kingpin nut 41. However, this greatly decreases the turning responsiveness of the truck 10.

Figure 6:
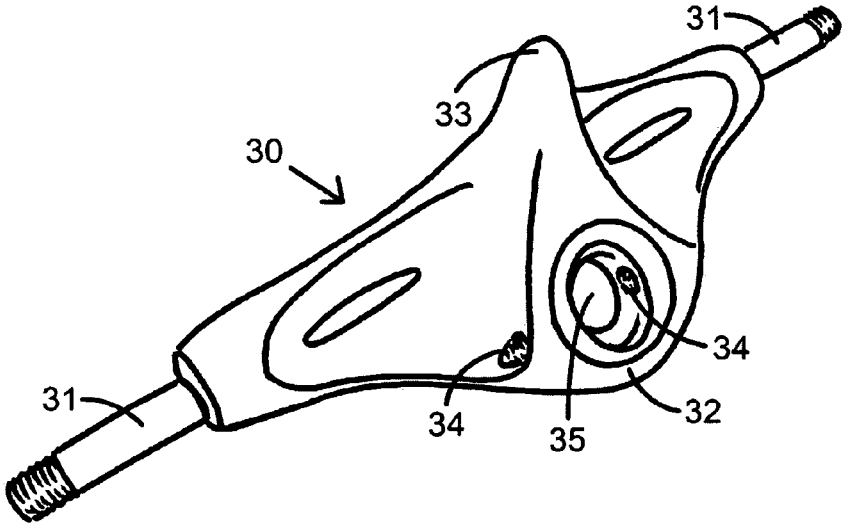
FIG. 6 is a perspective view of the hanger of the skateboard truck of the present invention.
Figure 7:
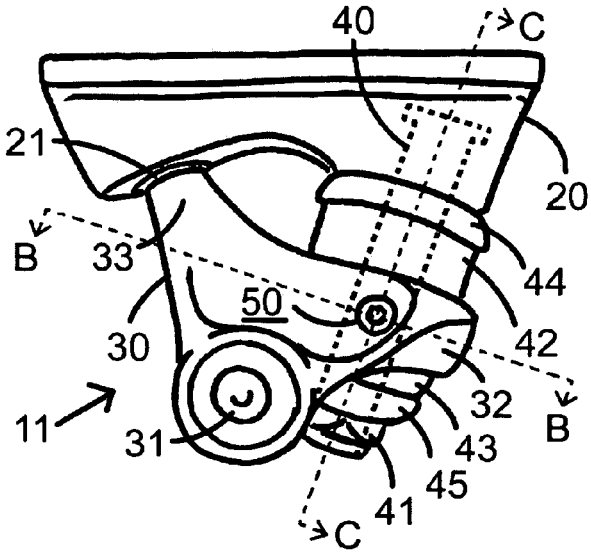
FIG. 7 is a side elevation view of the skateboard truck of the present invention.
Figure 10:
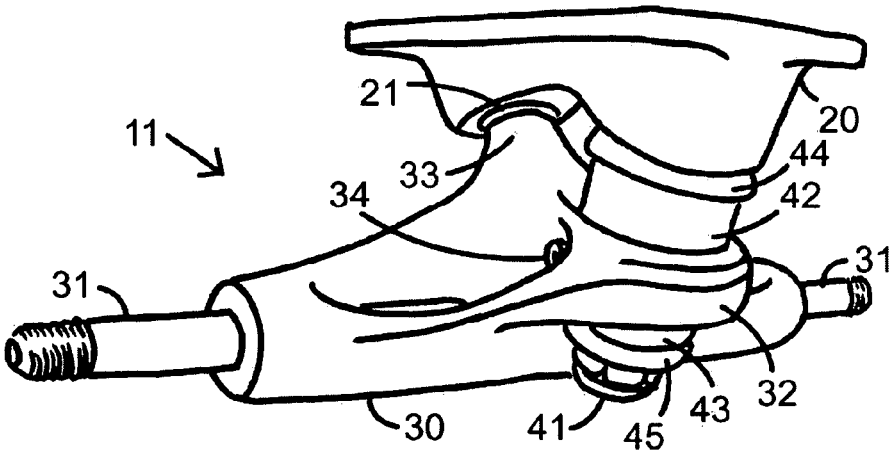
FIG. 10 is a perspective view of the assembled skateboard truck of the present invention.

FIG. 6 shows a perspective view of the hanger 30 of the present invention. A ring-shaped member 32 protrudes from a mid portion of the hanger 30 and defines an opening 35 through which a kingpin 40 can be routed. A plurality of bores 34 are defined in the ring-shaped member 32 about said opening 35, said bores 34 generally parallel to the longitudinal axis of the axle 31. FIG. 7 shows a side view of the assembled truck 11 of the present invention, with each bore 34 accepting a set screw 50, said set screw 50 adjacent to the kingpin 40. The term "set screw" is exemplary and is not meant to limit the scope of the present invention. There are many different types of rigid elements or fasteners, such as hex cap screws, thumb screws, or studs, that would also be effective at preventing wheel bite. FIG. 10 shows the complete assembled truck 11 and FIG. 11 shows the complete unassembled truck 11.

Figure 8A:
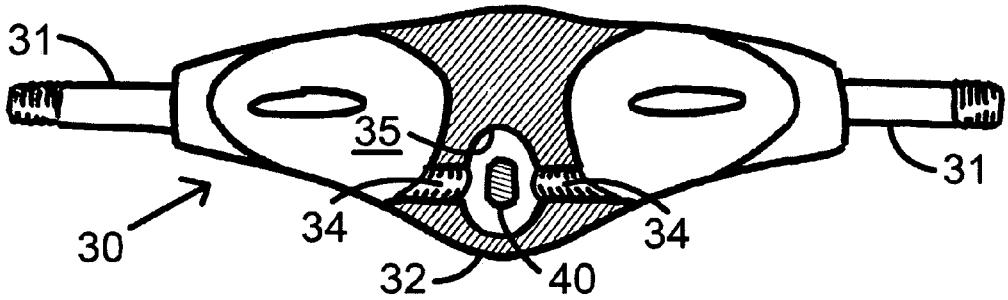
FIG. 8*a* is a cross-sectional view of the skateboard truck shown in FIG. 7 taken along line B—B with no set screws present.
Figure 8B:
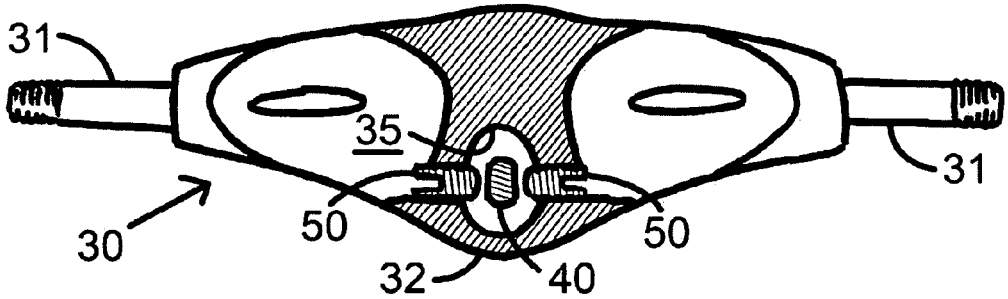
FIG. 8*b* is a cross-sectional view of the skateboard truck shown in FIG. 7 taken along line B—B with two set screws positioned close to the kingpin.
Figure 8C:
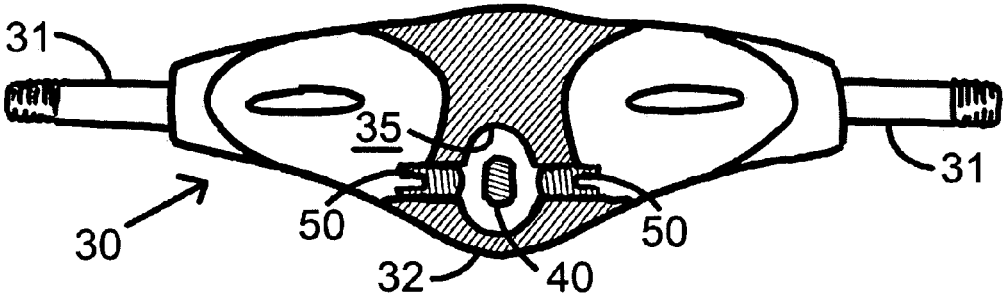
FIG. 8*c* is a cross-sectional view of the skateboard truck shown in FIG. 7 taken along line B—B with two set screws positioned far from the kingpin.

FIG. 8*a* shows a cross-sectional view of the hanger 30 and kingpin 40 shown in FIG. 7 taken along line B—B. The bores 34 are shown without set screws 50 inserted therein. FIG. 8*b* shows a cross-sectional view of the hanger 30, kingpin 40, and set screws 50 shown in FIG. 7 taken along line B—B. The set screws 50 are inserted into the bores 34 and positioned a close distance from the kingpin 40. FIG. 8*c* shows a cross-sectional view of the hanger 30, kingpin 40, and set screws 50 shown in FIG. 7 taken along line B—B. The set screws 50 are inserted into the bores 34 and positioned a far distance from the kingpin 40.

Figures 9A, 9B, 9C, 9D:
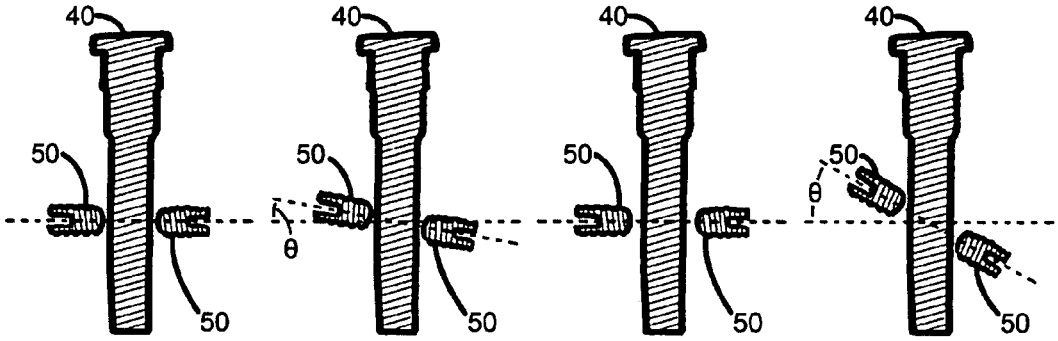
FIG. 9*a* is a cross-sectional view of the kingpin and set screws shown in FIG. 7 taken along line C—C with said set screws positioned close to said kingpin.
FIG. 9*b* is a cross-sectional view of the kingpin and set screws shown in FIG. 9*a* with said set screws pivoting through an angle θ.
FIG. 9*c* is a cross-sectional view of the kingpin and set screws shown in FIG. 7 taken along line C—C with said set screws positioned far from said kingpin.
FIG. 9*d* is a cross-sectional view of the kingpin and set screws shown in FIG. 9*c* with said set screws pivoting through an angle θ.

The distance between each set screw 50 and the kingpin 40 determines the angle at which pivoting of the hanger 30 stops. FIG. 9*a* shows a cross-sectional view of the kingpin 40 and set screws 50 shown in FIG. 7 taken along line C—C. The set screws 50 are positioned a close distance from the kingpin 40 as in FIG. 8*b*. FIG. 9*b* shows the angle θ that the longitudinal axis of the set screws 50 of FIG. 9*a* can pivot before at least one set screw 50 contacts the kingpin 40. Because the hanger 30 and ring-shaped member 32 are rigid and in the assembled truck 11 the kingpin 40 is rigidly secured to the baseplate 20, contact between a set screw 50 and the kingpin 40 stops the hanger 30 from pivoting any further. FIG. 9*c* shows a cross-sectional view of the kingpin 40 and set screws 50 shown in FIG. 7 taken along line C—C. The set screws 50 are positioned a far distance from the kingpin 40 as in FIG. 8*c*. FIG. 9*d* shows the angle θ that the longitudinal axis of the set screws 50 of FIG. 9*c* can pivot before at least one set screw 50 contacts the kingpin 40. The angle θ at which further pivoting of the hanger 30 stops is smaller in FIG. 9*b* than in FIG. 9*d* because the set screws 50 are closer to the kingpin 40 in FIG. 9*b* than in FIG. 9*d*.

Figure 11:
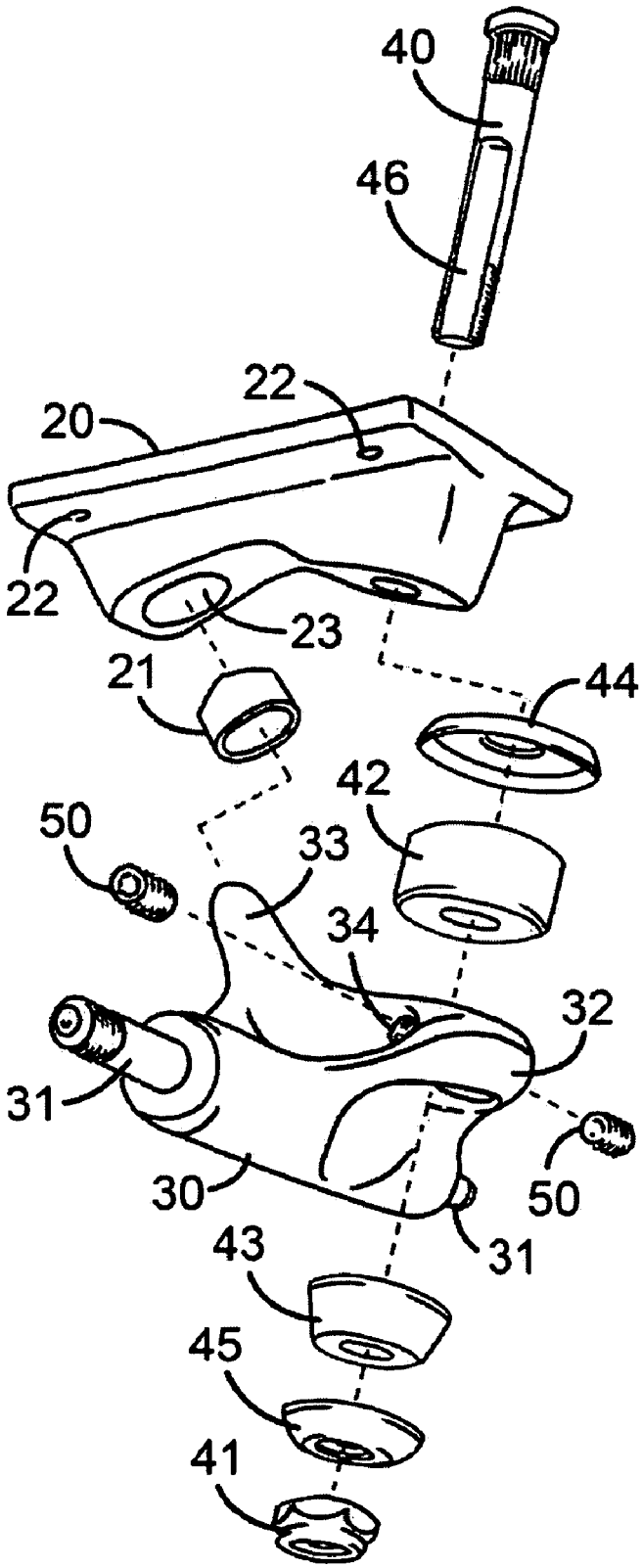
FIG. 11 is a perspective view of the unassembled skateboard truck of the present invention.

A plurality of flat surfaces 46 can be defined on the shaft of the kingpin 40 as shown in FIG. 11. In the assembled truck 11 the flat surface 46 adjacent to each set screw 50 provides a large area for said set screw 50 to contact said kingpin 40. Therefore, the angle through which the hanger 30 pivots to cause a set screw 50 to contact the kingpin 40 is not affected if said set screw 50 is not exactly lined up with the longitudinal centerline of said kingpin 40 or if said hanger 30 pivots about said kingpin 40 non-linearly.

Locking mechanisms, for example thread-locker or thread-sealant readily available from several manufactures, can be used in the bores 34 or on the set screws 50 to prevent the set screws 50 from moving due to vibration or wear. Nylon patches or special taps that can produce self-locking threads within the bores 34 can also be used to prevent the set screws 50 from moving due to vibration or wear.

Although a specific embodiment of the present invention has been illustrated and described, many variations or modifications would be apparent that do not depart from the spirit and scope of the invention. For example, the set screws 50 can be any rigid element. To reduce manufacturing costs at the expense of losing the adjustability of wheel bite prevention, the plurality of rigid elements can be statically fixed within the ring-shaped member 32, most likely cast in place.

Figure 12:
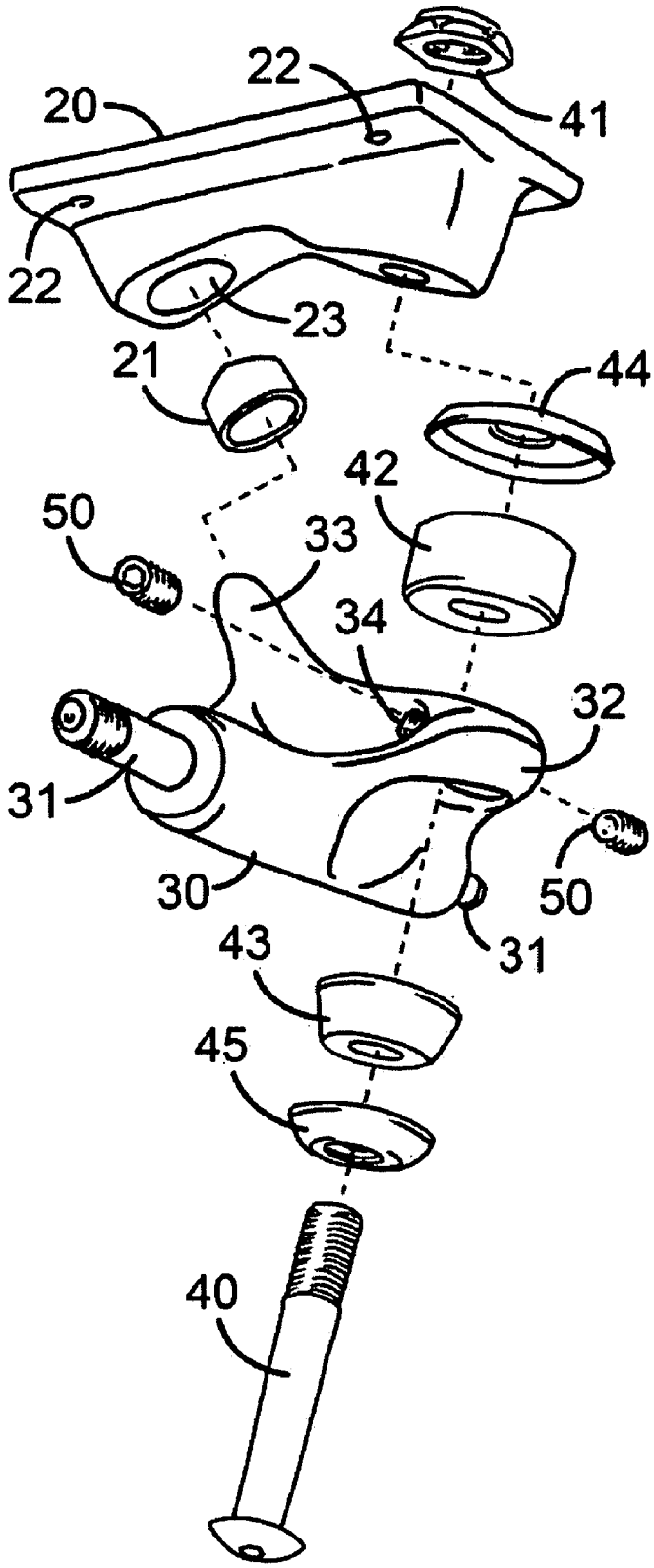
FIG. 12 is a perspective view of the unassembled skateboard truck of an alternate embodiment of the present invention.

FIG. 12 shows an alternate embodiment of the present invention, in which the positions of the kingpin 40 and kingpin nut 41 are reversed. This embodiment is undesired because the kingpin nut 41 is statically fixed and the kingpin 40 is rotated to adjust the turning responsiveness of the truck 11. If a flat surface 46 were included on the kingpin 40, the position of said flat surface 46 relative to a set screw 50 in the assembled truck 11 would change if said kingpin 40 were rotated, thereby obviating the purpose of said flat surface 46. Without any flat surfaces 46, the angle through which the hanger 30 pivots to cause a set screw 50 to contact the kingpin 40 may vary if said set screw 50 is not exactly lined up with the longitudinal centerline of said kingpin 40 or if said hanger 30 pivots about said kingpin 40 non-linearly.

The following claims completely define the present invention.

What is claimed is:

1. A skateboard truck assembly comprising:

a kingpin;

a plurality of bushings;

a plurality of set screws;

a baseplate configured to be secured to the underside of said skateboard, said baseplate including a pivot recess and said baseplate configured to accept said kingpin;

a hanger including an axle;

a pivot stem projecting from a mid portion of said hanger;

a ring-shaped member projecting from a mid portion of said hanger, said ring-shaped member defining an opening and said ring-shaped member including a plurality of bores substantially parallel to said axle;

wherein said pivot stem rests in said pivot recess;

said ring-shaped member is sandwiched between said plurality of bushings;

said kingpin is routed through said opening defined by said ring-shaped member, said kingpin is adjacent to said plurality of bores of said ring-shaped member, and said kingpin is accepted by said baseplate; and said plurality of bores of said ring-shaped member accept said plurality of set screws.

2. The skateboard truck assembly of claim 1 wherein the shaft of said kingpin includes a plurality of flat surfaces adjacent to said plurality of bores of said ring-shaped member.

3. A skateboard truck assembly comprising:

a kingpin;

a plurality of bushings;

a plurality of rigid elements;

a baseplate configured to be secured to the underside of said skateboard, said baseplate including a pivot recess and said baseplate configured to accept said kingpin;

a hanger including an axle;

a pivot stem projecting from a mid portion of said hanger;

a ring-shaped member projecting from a mid portion of said hanger, said ring-shaped member defining an opening and said ring-shaped member including a plurality of bores substantially parallel to said axle;

wherein said pivot stem rests in said pivot recess;

said ring-shaped member is sandwiched between said plurality of bushings;

said kingpin is routed through said opening defined by said ring-shaped member, said kingpin is adjacent to said plurality of bores of said ring-shaped member, and said kingpin is accepted by said baseplate; and said plurality of bores of said ring-shaped member accept said plurality of rigid elements.

4. The skateboard truck assembly of claim 3 wherein the shaft of said kingpin includes a plurality of flat surfaces adjacent to said plurality of bores of said ring-shaped member.

5. A skateboard truck assembly comprising:

a kingpin;

a plurality of bushings;

a plurality of rigid elements;

a baseplate configured to be secured to the underside of said skateboard, said baseplate including a pivot recess and said baseplate configured to accept said kingpin;

a hanger including an axle;

a pivot stem projecting from a mid portion of said hanger;

a ring-shaped member projecting from a mid portion of said hanger, said ring-shaped member defining an opening and said ring-shaped member including said plurality of rigid elements substantially parallel to said axle;

wherein said pivot stem rests in said pivot recess;

said ring-shaped member is sandwiched between said plurality of bushings;

said kingpin is routed through said opening defined by said ring-shaped member, said kingpin is adjacent to said plurality of rigid elements, and said kingpin is accepted by said baseplate.

6. The skateboard truck assembly of claim 5 wherein the shaft of said kingpin includes a plurality of flat surfaces adjacent to said plurality of rigid elements.

* * * * *